United States Patent [19]

Gizzi

[11] Patent Number: 4,832,293

[45] Date of Patent: May 23, 1989

[54] MULTIPURPOSE PAINT CAN ACCESSORY

[76] Inventor: Eugene A. Gizzi, 2701 SW. 13th Ave., Fort Lauderdale, Fla. 33315

[21] Appl. No.: 239,463

[22] Filed: Sep. 1, 1988

[51] Int. Cl.[4] ..... A46B 17/08

[52] U.S. Cl. ..... 248/110; 220/90; 220/94 R; 248/213.2; 294/2; 294/27.1

[58] Field of Search ..... 220/90, 94 R; 248/213.2, 110; 294/2, 15, 27.1

[56] References Cited

U.S. PATENT DOCUMENTS

| | | | |
|---|---|---|---|
| 3,292,815 | 12/1966 | Smith et al. | 220/94 R |
| 4,014,453 | 3/1977 | Tarnacki | 220/90 |
| 4,023,702 | 5/1977 | McKnight | 220/94 R |
| 4,145,789 | 3/1979 | Morgan | 220/90 X |
| 4,258,947 | 3/1981 | Thompson et al. | 294/15 |
| 4,266,746 | 5/1981 | Klaiber | 220/90 X |

*Primary Examiner*—Stephen Hepperle
*Attorney, Agent, or Firm*—Alvin S. Blum

[57] ABSTRACT

An accessory attaches to the bail of a paint can. It provides a wiping edge for wiping excess paint from the bristles of a paint brush. It also provides a brush-holding device for holding a paint brush that permits paint from the brush to drain into the container. The accessory further provides a paint-free carrying handle that lifts the can by the bail for balanced carrying while the brush is held in place.

8 Claims, 3 Drawing Sheets

MULTIPURPOSE PAINT CAN ACCESSORY

BACKGROUND OF THE INVENTION

This invention relates to painting accessories and more particularly to an accessory that engages a paint can, holds a brush, provides a means for wiping excess paint from the bristles, and provides a paint-free carrying handle for the can and brush together.

Paint brush wiper attachments as exemplified by U.S. Pat. Nos. 4,721,225; 4,101,046; 4,275,818; 3,998,352; 3,948,413; 3,945,527; 3,899,107; 3,776,415; 2,803,374; 2,788,153 generally engage the rim of the paint can for stability. This is not a very stable or convenient means for carrying the opened can with a wet brush. A painter must frequently move the opened paint can and a wet brush in the process of painting a large area. It would be desirable to have an accessory that: readily attaches to an opened paint can; that holds the brush when wet with any surplus draining into the can; that provides a convenient wiping edge for wiping excess paint from the bristles and that provides a balanced lifting handle free of paint.

SUMMARY OF THE INVENTION

It is accordingly an object of the invention to provide an accessory that snaps onto the bail of a container as exemplified by a paint can, said accessory providing a clean, dry carrying handle that remains free of paint and that permits the bail to swing freely to provide maximum balance when carrying.

It is yet another object of the invention to provide said accessory in combination with brush holding means that holds a wet brush with bristles dependent and draining into the open container.

It is yet another object to provide said accessory in combination with a wiping edge for wiping excess liquid from the bristles, wherein said liquid also drains into said open container. The accessory of the invention includes in combination:

(a) bail engaging means for removably engaging the bail of a container;

(b) brush holding means for removably engaging the handle of a brush while positioning the wet end to drain into the open container;

(c) and brush wiping means for wiping excess liquid from the brush, wherein said liquid drains into the open container.

The accessory is arranged to be molded in one piece from a material impervious to the contents of the container for economy of manufacture and effectiveness of use.

These and other objects and advantages of the invention will become evident from the detailed description of the invention which follows and the appended drawings.

DETAILED DESCRIPTION OF PREFERRED EMBODIMENTS

Figure 1:
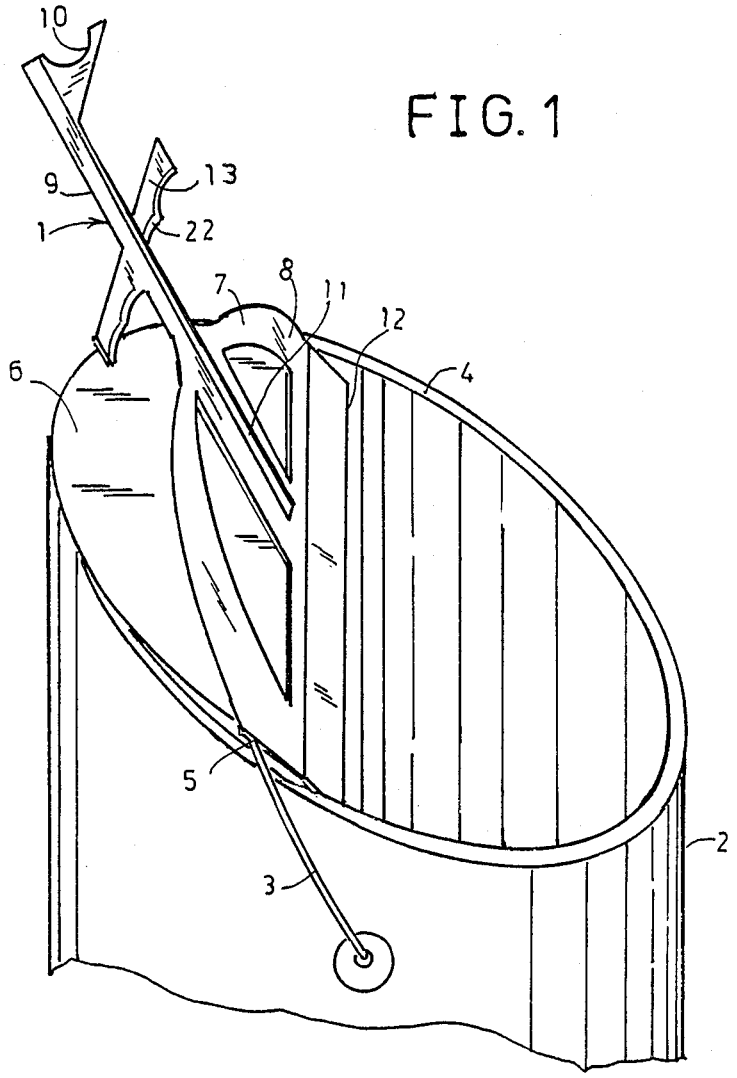
FIG. 1 is a perspective view of the accessory in use on a container.
Figures 2, 3, 6:
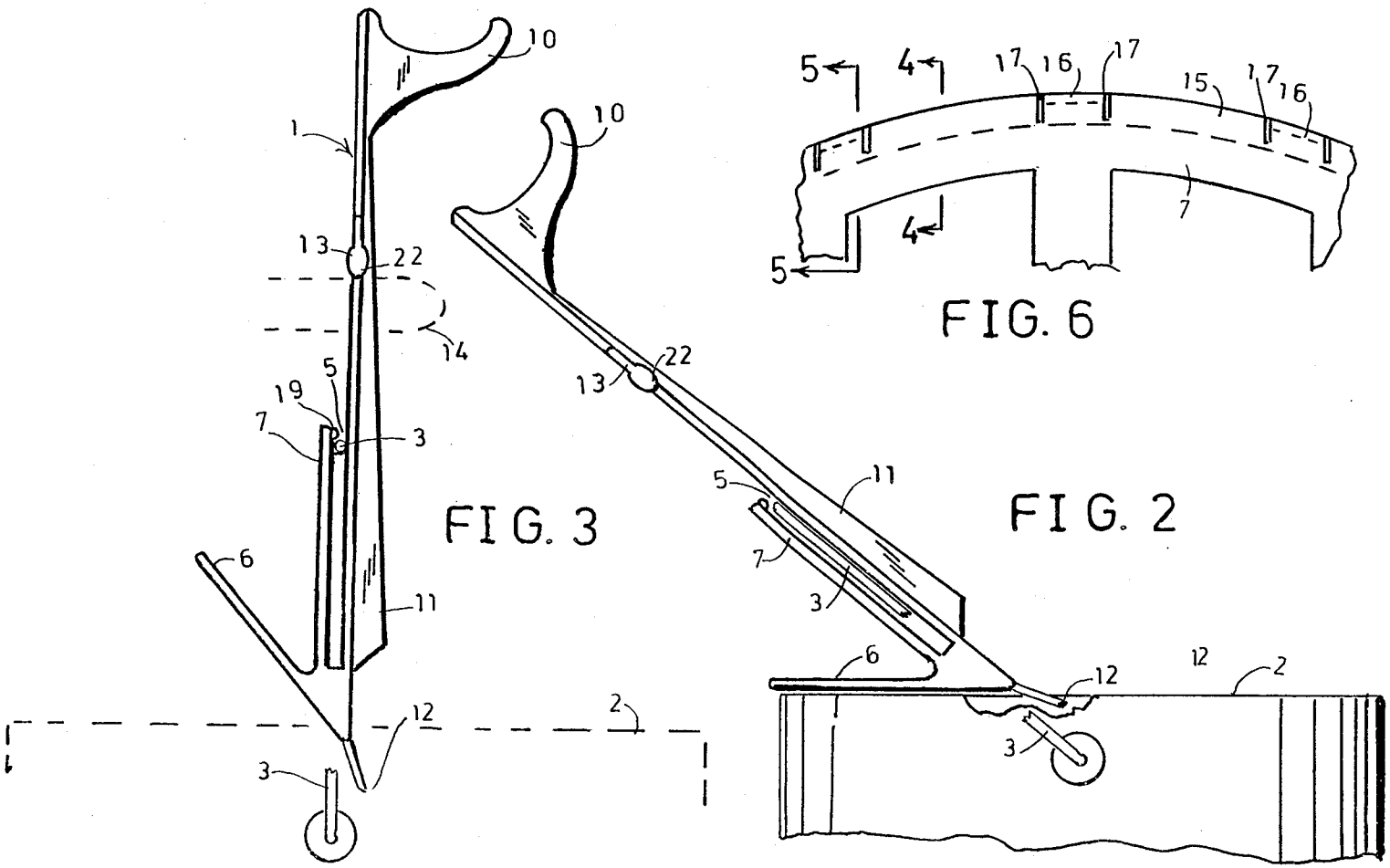
FIG. 2 is a side elevation view of the accessory on a container.
FIG. 3 is a side elevation view of the accessory lfting a container.
FIG. 6 is a rear elevation view detail of the bail-engaging means.

Referring now first to FIG. 1, the paint can accessory 1 is shown mounted on a conventional paint can 2, resting atop the rim 4 and engaging the bail 3 in a bail-engaging groove 5. The accessory 1 includes a base plate 6 that rests upon the rim 4, joined at an angle of approximately 40 degrees to a support element 8 that includes an arcuate member 7 that includes bail-engaging groove 5 and an elongate body 9, terminating in a hook 10 for engaging a hole in the handle of a paint brush. The paint brush handle will rest upon tapered rib 11 and the brush bristles will rest upon scraper edge 12 so that any paint on the bristles will drip back into the can. This is the position for the accessory in ordinary use. The bursh remains on the hook when not in use. The brush may be removed from the hook, dipped into the paint, and excess paint scraped off on scraper edge 12. FIG. 2 is a side elevation view with a portion of the can broken away to show that the scraper edge extends downwardly into the can to ensure that all drippings are retained within the can. The paint can is lifted and carried by the finger holds 13 as best shown in FIG. 3 with finger 14 shown in phantom. The accessory lifts the can by the bail 3. The bail is shown partially broken away in FIGS. 2 and 3 to more clearly illustrate how bail 3 fits in bail-engaging groove 5 in arcuate member 7. Because the bail swings freely in its pivots on the container, carrying by the finger holds 13 permits the open can to swing into balance, for easy spill-proof carrying. The wet paint brush may be hung on brush hook 10 to be carried along with the open can with no extra effort and the carrying finger holds always remain removed from the paint, so that carrying is less likely to soil the hands than lifting by the bail alone. A thicker and rounded lower margin 22 of finger hold 13 makes carrying a heavy can more comfortable. The base plate 6 makes a convenient shelf for holding such things as putty, tape and the like.

Figure 5:
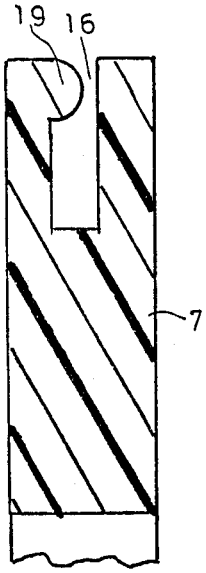
FIG. 5 is a cross section detail through 5–5 of FIG. 6.
Figure 4:
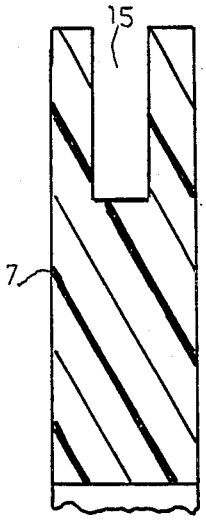
FIG. 4 is a cross section detail through 4–4 of FIG. 6.
Figure 7:
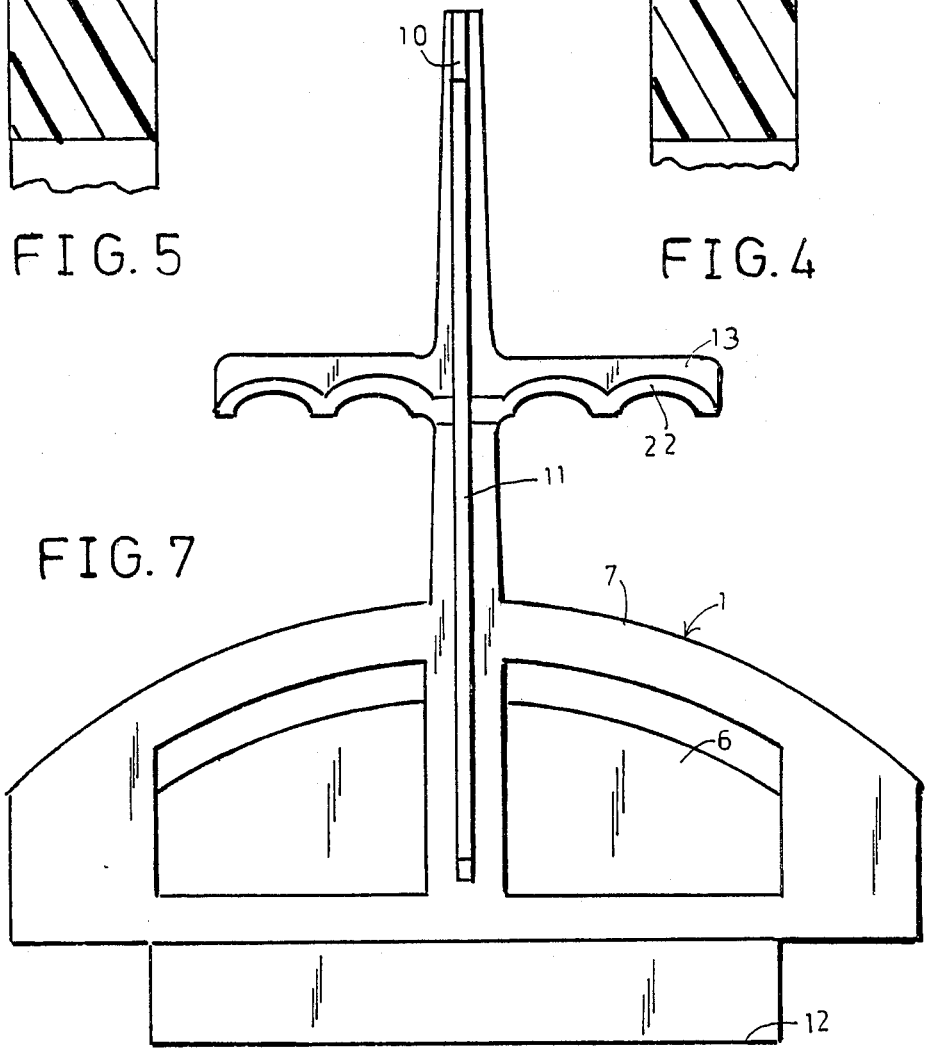
FIG. 7 is a front elevation view of the accessory.

FIG. 7 shows the accessory 1 in front elevation and FIG. 6 shows in rear elevation a detail of the bail-engaging groove 5 which includes open groove regions 15 and snap-closed groove regions 16 bordered by slots 17 to permit the snap-closed regions 16 to spring open to admit the bail 3 and to snap closed over the bail to more securely engage the bail. The cross section details of FIG. 4 illustrates the open groove region 15 and FIG. 5 illustrates the snap-closed region 16 with a rounded protuberance 19 that elastically springs open and closed about the bail. The accessory 1 is constructed so that it can be readily molded of plastic in one piece.

Figure 8:
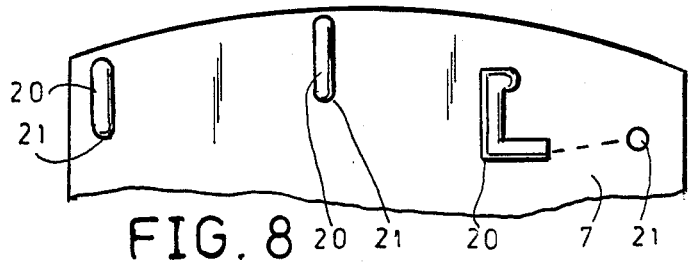
FIG. 8 is a rear elevation view detail of an alternative bail-engaging means.

In an alternative embodiment of a bail-engaging means illustrated in FIG. 8, molded plastic pins 20 are secured in holes 21 in arcuate member 7. One pin is shown in side elevation removed from its hole. The rounded protuberance 19 springs open and snaps closed around the bail and the bail rests against the pin 20 at horizontal portion 22 which serves the function of the groove 5 of the other embodiment.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. An accessory for use with a container having a pivotally mounted carrying ball that provides brush holding, brush wiping and clean carrying handle functions, comprising:

(a) bail-engaging means for removably attaching said accessory to said bail, thereby enabling said accessory to pivot from a first, resting position to a second, carrying position;

(b) brush wiping means including a draining surface extending downwardly into said container said surface terminating in a scraping edge at its lowermost portion to ensure that excess fluid wiped from said brush drains into said container;

(c) brush holding means for removably engaging said brush while providing for draining fluid from said brush into said container, said brush holding means holding said brush so that its bristle portion is at said wiping means;

(d) carrying handle means connected to said bail-engaging means for lifting said container by said bail, said handle means arranged on said accessory to remain above said container in said first, resting position to reduce its exposure to contamination; and (e) base plate means for resting upon the upper surface of said container when said accessory is in said first, resting position; said bail-engaging means, said brush holding means, said carrying handle means and said brush wiping means fixedly connected together and fixedly connected to said base plate means at an angle to hold said bail-engaging means, said brush holding means, and said carrying handle means above said container and to position said wiping means to drain into said container.

2. The accessory according to claim 1, in which said brush holding means includes a hook for engaging a hole in the handle of a brush.

3. The accessory according to claim 1, in which said bail-engaging means includes a groove means substantially conforming to the shape of said bail into which said bail fits.

4. The accessory according to claim 3, in which said groove means includes springy portions which spring open to admit said bail to said groove means and spring closed over said bail to more securely engage said bail.

5. The accessory according to claim 1, in which said bail-engaging means includes a surface for engaging a first side of said bail and a plurality of springy pin means arranged on said surface in a substantially arcuate orientation corresponding to the shape of said bail, said pin means engaging a second side of said bail and the lower portion of said bail.

6. The accessory according to claim 5, in which said pin means includes springy upper portions which spring open to admit said bail and spring closed over said bail to more securely engage said bail.

7. The accessory according to claim 1, formed of a single molded piece of plastic.

8. The accessory according to claim 1, in which said base plate means includes a storage shelf.

* * * * *